US009126791B2

(12) United States Patent
Inoue

(10) Patent No.: US 9,126,791 B2
(45) Date of Patent: Sep. 8, 2015

(54) CONVEYER APPARATUS

(71) Applicant: RISO KAGAKU CORPORATION, Tokyo (JP)

(72) Inventor: Hideaki Inoue, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/098,671

(22) Filed: Dec. 6, 2013

(65) Prior Publication Data

US 2014/0167351 A1 Jun. 19, 2014

(30) Foreign Application Priority Data

Dec. 14, 2012 (JP) ..... 2012-273023

(51) Int. Cl.

| | |
|---|---|
| ***B65H 9/04*** | (2006.01) |
| ***B65H 3/44*** | (2006.01) |
| ***B65H 7/02*** | (2006.01) |
| ***G03G 15/00*** | (2006.01) |
| *B65H 9/00* | (2006.01) |

(52) U.S. Cl.

CPC .. *B65H 3/44* (2013.01); *B65H 7/02* (2013.01); *B65H 9/008* (2013.01); *G03G 15/6502* (2013.01); *B65H 9/006* (2013.01); *B65H 2404/7231* (2013.01); *B65H 2404/7232* (2013.01); *B65H 2511/51* (2013.01); *B65H 2513/108* (2013.01); *B65H 2513/11* (2013.01); *B65H 2513/50* (2013.01); *B65H 2515/322* (2013.01); *B65H 2701/1311* (2013.01); *B65H 2701/1313* (2013.01); *B65H 2801/06* (2013.01)

(58) Field of Classification Search

CPC ..... B65H 9/006; B65H 9/008; B65H 2404/7231; B65H 2404/7332

USPC ..... 271/242, 244

See application file for complete search history.

(56) References Cited

U.S. PATENT DOCUMENTS

| | | | | |
|---|---|---|---|---|
| 5,904,350 | A * | 5/1999 | Creighton et al. | 271/227 |
| 2004/0239027 | A1* | 12/2004 | Trovinger et al. | 271/227 |
| 2013/0168923 | A1* | 7/2013 | Sugimoto | 271/258.01 |

FOREIGN PATENT DOCUMENTS

| | | |
|---|---|---|
| JP | 2010-111427 | 5/2010 |

* cited by examiner

*Primary Examiner* — Howard Sanders

(74) *Attorney, Agent, or Firm* — Greenblum & Bernstein P.L.C.

(57) ABSTRACT

A conveyance apparatus includes a pair of registration rollers configured to convey a print medium to a printing unit of a printing machine in a conveyance direction, a motor configured to rotate the registration rollers, and a controller configured to control the motor such that after the print medium strikes the registration rollers and thereby forms a predetermined amount of slack in the print medium, the motor starts rotating the registration rollers to convey the print medium, and the motor stops rotating the registration rollers once the print medium exits the registration rollers. In stopping rotating the registration rollers, the controller is configured to drive the motor to generate torque in a reverse rotational direction opposite from a rotational direction in which the motor generates torque to convey the print medium in the conveyance direction.

6 Claims, 5 Drawing Sheets

UP
DOWN
LEFT
RIGHT

CONVEYER APPARATUS

CROSS REFERENCE TO RELATED APPLICATION

This application is based upon and claims the benefit of priority from the prior Japanese Patent Application No. 2012-273023, filed on Dec. 14, 2012, the entire contents of which are incorporated herein by reference.

BACKGROUND

1. Technical Field

The present invention relates to a conveyer apparatus which conveys a print medium such as a sheet of paper.

2. Related Art

Japanese Unexamined Patent Application Publication No. 2010-111472 describes a conveyance mechanism which is employed in a printing machine of inkjet type or the like and configured to feed a sheet toward a printing unit with registration rollers.

In this conveyance mechanism, inclination of a sheet is corrected by striking the sheet against a pair of stopped registration rollers so that the sheet may stop to form slack therein. Thereafter, the registration rollers are driven to feed the sheet to a printing unit. The registration rollers are stopped once the sheet exits the registration rollers.

The registration rollers are stopped by short-circuit brake control. In the short-circuit brake control, terminals of a DC motor for driving the registration rollers are short-circuited.

SUMMARY

The short-circuit brake control requires a certain amount of time from when short-circuit brake is performed to when the registration rollers stop, because of influences, such as inertia and load, of a transmission mechanism from a motor shaft to the registration rollers. Moreover, the time may vary in length.

Thus, if the interval between sheets is small in a case of printing multiple sheets, the leading edge of a succeeding sheet might reach the registration rollers before the registration rollers stop. If a sheet enters the unstopped registration rollers with the sheet being inclined, the sheet is nipped in that state. This may result in failure in correcting the inclination. To avoid this, the sheet interval needs to be set long, but a long sheet interval leads to a decrease in the productivity of the printing machine.

The present invention has an objective of providing a conveyer apparatus capable of improving the productivity a printing machine.

A conveyance apparatus in accordance with some embodiments includes a pair of registration rollers configured to convey a print medium to a printing unit of a printing machine in a conveyance direction, a motor configured to rotate the registration rollers, and a controller configured to control the motor such that after the print medium strikes the registration rollers and thereby forms a predetermined amount of slack in the print medium, the motor starts rotating the registration rollers to convey the print medium, and the motor stops rotating the registration rollers once the print medium exits the registration rollers. In stopping rotating the registration rollers, the controller is configured to drive the motor to generate torque in a reverse rotational direction opposite from a rotational direction in which the motor generates torque to convey the print medium in the conveyance direction.

According to the above configuration, in stopping the registration rollers, the motor generates torque in the reverse rotational direction which is opposite from the rotational direction in which the motor generates torque to convey the print medium in the conveyance direction. This can shorten a time period from a stop-control start timing to when the registration rollers stop. Thus, the interval between sheets in printing multiple sheets can be reduced. As a result, the productivity of the printing machine can be improved.

The controller may be configured to control the motor such that, from a timing when the print medium strikes the registration rollers, the motor temporarily rotates the registration rollers in a reverse rotational direction opposite from a rotational direction in which the registration rollers are rotated in conveying the print medium in the conveyance direction.

According to the above configuration, from a timing when the print medium strikes the registration rollers, the registration rollers are temporarily rotated in the reverse rotational direction which is opposite from the rotational direction in which the registration rollers are rotated in conveying the print medium in the conveyance direction. Thereby, the print medium can be prevented from being nipped by the registration rollers when striking them. As a result, failure in correcting the inclination of the print medium can be reduced.

The controller may be configured to control the motor such that, after the print medium strikes the registration rollers and thereby forms the predetermined amount of slack in the print medium and before the motor drives the registration rollers to start conveying the print medium, the motor temporarily rotates the registration rollers in a reverse rotational direction opposite from a direction in which the registration rollers are rotated in conveying the print medium in the conveyance direction.

According to the above configuration, after the print medium strikes the registration rollers and thereby forms the predetermined amount of slack in the print medium and before the registration rollers start to convey the print medium, the registration rollers are temporarily rotated in the reverse rotational direction which are opposite from the rotational direction in which the registration rollers are rotated in conveying the print medium in the conveyance direction. Thereby, in a case where a leading edge portion of the print medium is nipped by the registration rollers, the leading edge of the print medium can be released from the nipping and returned to the nip line. As a result, failure in correcting the inclination of the print medium can be reduced.

DETAILED DESCRIPTION

Figure 1:
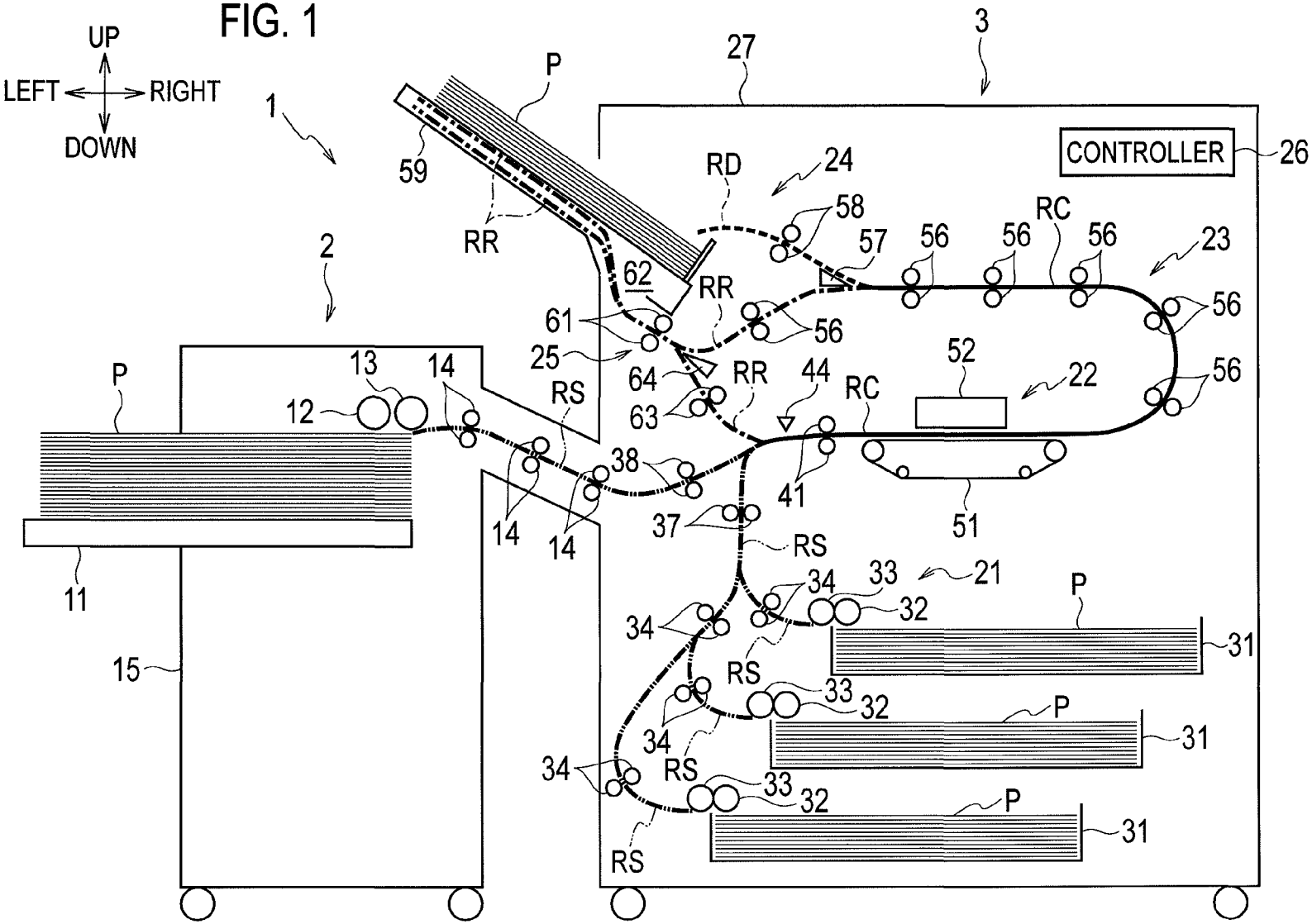
FIG. 1 is a diagram showing the overall configuration of a printing system according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
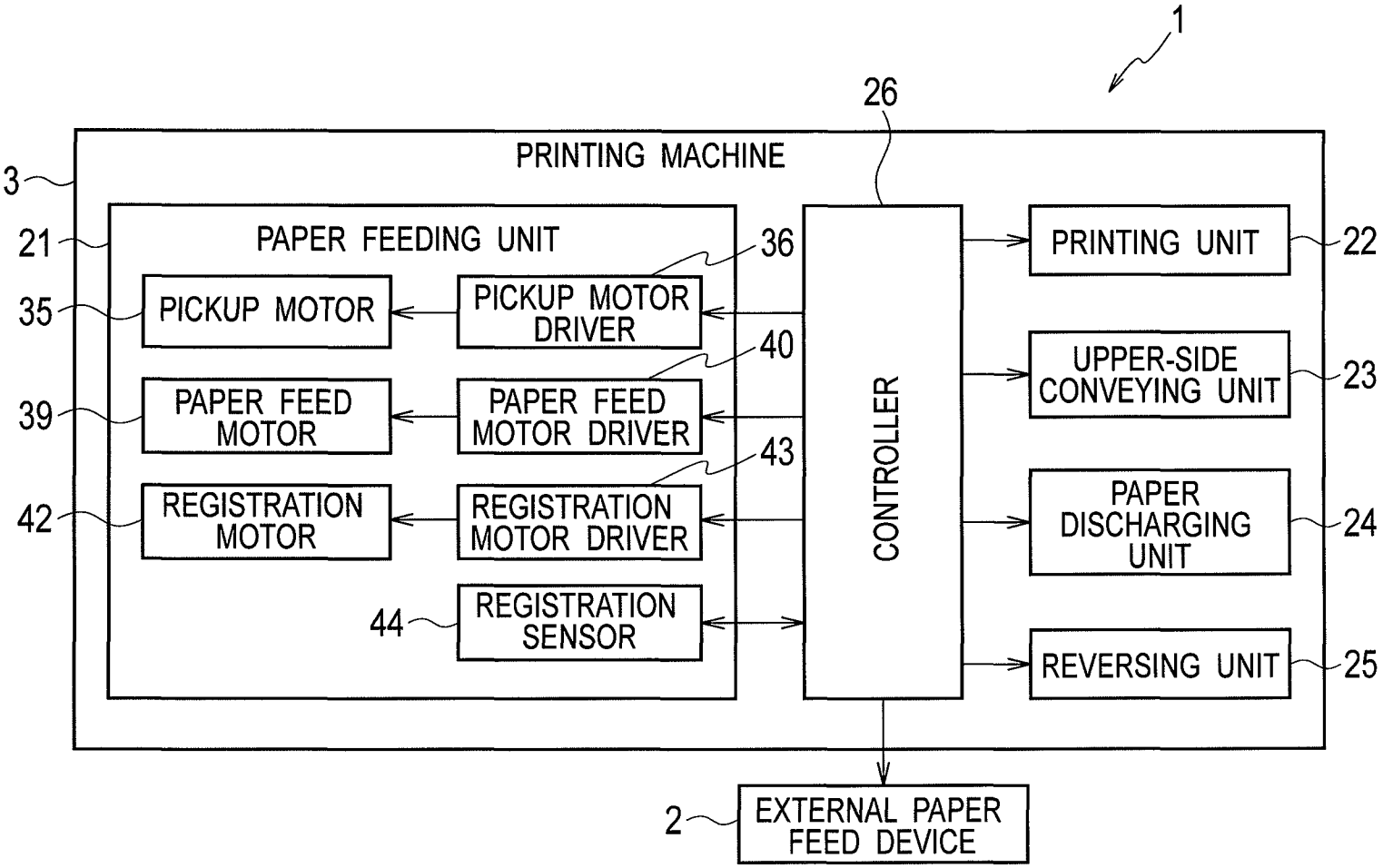
FIG. 2 is a block diagram showing the configuration of a control system of the printing system according to the embodiment of the present invention.

FIG. 1 is a diagram showing the overall configuration of a printing system according to an embodiment of the present invention. FIG. 2 is a block diagram showing the configuration of a control system of the printing system. In the following description, front means a position where a user stands, the front side of the paper plane of FIG. 1. Further, as shown in FIG. 1, up, down, left, and right directions in the following description are up, down, left, and right as seen by the user.

Thick lines in FIG. 1 are conveyance routes along which a sheet P (print medium) is conveyed. Among the conveyance routes, a regular route RC is shown with a solid line, an reverse route RR is shown with a one-dot chain line, a sheet discharge route RD is a route shown with a broken line, and a sheet feed route RS is shown with a two-dot chain line. Upstream and downstream mentioned in the following description mean upstream and downstream of these conveyance routes.

As shown in FIGS. 1 and 2, a printing system 1 according to this embodiment includes an external paper feed device 2 and a printing machine 3.

The external paper feed device 2 is configured to feed the sheet P to the printing machine 3, and is capable of holding a large amount of sheets P. The external paper feed device 2 is connected to the upstream side of the printing machine 3. The external paper feed device 2 includes a paper feed tray 11, a scraper roller 12, a pickup roller 13, multiple pairs of intermediate conveying rollers 14, and a casing 15 configured to house or hold these parts.

The paper feed tray 11 is configured such that sheets P used for printing are stacked thereon. The paper feed tray 11 is placed in such a manner as to be partially exposed to the outside of the casing 15. The paper feed tray 11 is configured such that it can be moved up and down by a motor (not shown).

The scraper roller 12 is configured to separate an uppermost one of the sheets P stacked on the paper feed tray 11 by coming into contact with the uppermost one of the stacked sheets P and rotating, and thereby feed the uppermost sheet P toward the pickup roller 13 (rightward). The scraper roller 12 is placed above a right end portion of the paper feed tray 11. The scraper roller 12 is configured to follow the rotation of the pickup roller 13 by a drive-power transmission mechanism (not shown).

The pickup roller 13 picks up the sheet P between the pickup roller 13 and a separating plate (not shown) placed below the pickup roller 13, and sends the sheet P to the right. The pickup roller 13 is placed adjacently on the right side of the scraper roller 12. The pickup roller 13 is driven to rotate by a motor (not shown).

The intermediate conveying rollers 14 are configured to convey the sheet P picked up from the paper feed tray 11 by the scraper roller 12 and the pickup roller 13 to external paper feeding rollers 38 to be described later. The intermediate conveying rollers 14 are placed along the paper feed route RS. The intermediate conveying rollers 14 are driven to rotate by a motor (not shown).

The printing machine 3 is configured to print on the sheet P. The printing machine 3 includes a paper feeding unit 21, a printing unit 22, an upper-side conveying unit 23, a paper discharging unit 24, a reversing unit 25, a controller 26, and a casing 27 configured to house or hold these units. Note that the printing machine 3 may only include some parts of the paper feeding unit 21 (registration rollers 41, a registration motor 42, and a registration motor driver 43 to be described later) and the controller 26.

The paper feeding unit 21 is configured to feed the sheet P to the printing unit 22. The paper feeding unit 21 is provided inside the casing 27. The paper feeding unit 21 includes multiple paper feed trays 31, multiple scraper rollers 32, multiple pickup rollers 33, multiple pairs of vertical conveying rollers 34, a pickup motor 35, a pickup motor driver 36, a pair of internal paper feeding rollers 37, a pair of external paper feeding rollers 38, a paper feed motor 39, a paper feed motor driver 40, a pair of registration rollers 41, a registration motor 42, a registration motor driver 43, and a registration sensor 44.

Each paper feed tray 31 is configured such that sheets P used for printing are stacked thereon. The paper feed trays 31 are placed inside the casing 27, at a lower portion thereof.

Each scraper roller 32 is configured to separate an uppermost one of the sheets P stacked on the corresponding paper feed tray 31 by coming into contact with the uppermost sheet P and rotating, and feed the uppermost sheet P to the left. The scraper roller 32 is placed above a left end portion of the paper feed tray 31. The scraper roller 32 is configured to follow the rotation of the pickup roller 33 by a drive-power transmission mechanism (not shown).

Each pickup roller 33 is configured to pick up the sheet P between the pickup roller 33 and a separating plate (not shown) placed under the pickup roller 33, and feed the sheet P to the left. The pickup roller 33 is placed adjacently on the left side of the corresponding scraper roller 32.

Each pair of vertical conveying rollers 34 is configured to convey the sheet P picked up from the paper feed tray 31 by the scraper roller 32 and the pickup roller 33 to the internal paper feeding rollers 37. The pairs of vertical conveying rollers 34 are placed along the paper feed routes RS.

The pickup motor 35 is configured to rotate the multiple pickup rollers 33 and the multiple pairs of vertical conveying rollers 34. As described earlier, when the pickup rollers 33 rotate, the scraper rollers 32 rotate, too. The pickup motor is configured to be capable of connecting to and disconnecting from each pickup roller 33 and each pair of vertical conveying roller 34 by a clutch (not shown). The pickup roller 33, the scraper roller 32, and the vertical conveying rollers 34 to be rotated by the pickup motor 35 are switched by the clutch.

The pickup motor driver 36 is configured to drive the pickup motor 35.

The pair of internal paper feeding rollers 37 is configured to convey the sheet P conveyed by the vertical conveying rollers 34 to the registration rollers 41.

The pair of external paper feeding rollers 38 is configured to convey the sheet P conveyed by the intermediate conveying rollers 14 of the external paper feed device 2, to the registration rollers 41.

The paper feed motor 39 is configured to rotate the internal paper feeding rollers 37 and the external paper feeding rollers 38. The paper feed motor 39 is connected to the internal paper feeding rollers 37 and the external paper feeding rollers 38 via a one-way clutch (not shown). By this one-way clutch, the internal paper feeding rollers 37 are rotated when the paper feed motor 39 is driven in one of rotational directions, and the external paper feeding rollers 38 are rotated when the paper feed motor 39 is driven in the other rotational direction.

The paper feed motor driver 40 is configured to drive the paper feed motor 39.

The pair of registration rollers 41 is configured to provide slack to the sheet P conveyed by the internal paper feeding rollers 37, the external paper feeding rollers 38, or paper re-feed rollers 63, by stopping the sheet P, and thereafter convey the sheet P to the printing unit 22 while nipping the sheet P. The registration rollers 41 are placed on the regular route RC, near the merging point between the paper feed route RS and the reverse route RR.

The registration motor 42 is configured to rotate the registration rollers 41. The rotational drive power of the registration motor 42 is transmitted to the registration rollers 41 by a transmission mechanism (not shown) including gears, a belt, and the like.

The registration motor driver 43 is configured to drive the registration motor 42.

The registration sensor 44 is configured to detect the sheet P to be conveyed to the registration rollers 41. The registration sensor 44 is placed near the upstream side of the registration rollers 41. The registration sensor 44 is formed by an optical sensor having a light emitting element and a light receiving element.

The printing unit 22 is configured to print on the sheet P while conveying the sheet P. The printing unit 22 is placed downstream of the paper feeding unit 21. The printing unit 22 includes a belt conveyer 51 and an inkjet head unit 52.

The belt conveyer 51 is configured to suck and retain the sheet conveyed from the registration rollers 41 on a belt, and conveys the sheet P to the upper-side conveying unit 23. The belt conveyer 51 is placed downstream of the registration rollers 41. The belt conveyer 51 is driven by a motor (not shown).

The inkjet head unit 52 has multiple line-type inkjet heads (not shown) each having multiple nozzles arranged in a direction (a front-rear direction) substantially orthogonal to a conveyance direction of the sheet P. The inkjet head unit 52 is placed above the belt conveyer 51. The inkjet head unit 52 is configured to print an image on the sheet P conveyed by the belt conveyer 51 by ejecting ink from the inkjet heads.

The upper-side conveying unit 23 is configured to convey the sheet P conveyed by the belt conveyer 51, to the right and then to the left such that the sheet P makes a U-turn. The upper-side conveying unit 23 includes multiple pairs of upper-side conveying rollers 56.

Each pair of upper-side conveying rollers 56 is configured to convey the sheet P while nipping the sheet P. The most downstream pair of the upper-side conveying rollers 56 is placed at the upstream portion of the reverse route RR. Other pairs of the upper-side conveying rollers 56 are arranged along the regular route RC between the printing unit 22 and the paper discharging unit 24. The multiple pairs of the upper-side conveying rollers 56 are driven to rotate by multiple motors (not shown).

The paper discharging unit 24 is configured to discharge a printed sheet P. The paper discharging unit 24 includes a switcher 57, a pair of paper discharging rollers 58, and a paper receiving tray 59.

The switcher 57 is configured to switch the conveyance route of the sheet P between the paper discharge route RD and the reverse route RR. The switcher 57 is placed at a branch point of the paper discharge route RD and the reverse route RR. The switcher 57 is driven by a solenoid (not shown).

The pair of paper discharging rollers 58 is configured to convey the sheet P led to the paper discharge route RD by the switcher 57 and discharge the sheet P to the paper receiving tray 59. The paper discharging rollers 58 are placed on the paper discharge route RD, between the switcher 57 and the paper receiving tray 59. The paper discharging rollers 58 are driven to rotate by a motor (not shown).

The paper receiving tray 59 is configured such that the discharged sheet P is stacked thereon. The paper receiving tray 59 is placed at a downstream end of the paper discharge route RD.

The reversing unit 25 is configured to, in double-sided printing, reverse the sheet P printed on one side thereof and convey the sheet P to the registration rollers 41. The reversing unit 25 includes a pair of reversing rollers 61, a switchback section 62, a pair of paper re-feed rollers 63, and a switch gate 64.

The pair of reversing rollers 61 is configured to convey the sheet P conveyed by the upper-side conveying unit 23, into the switchback section 62 temporarily and then convey the sheet P out of the switchback section 62 to the paper re-feed rollers 63. The reversing rollers 61 are placed on the reverse route RR, between the most downstream pair of upper-side conveying rollers 56 and an entry side of the switchback section 62. The reversing rollers 61 are driven to rotate by a motor (not shown).

The switchback section 62 is a space into which the reversing rollers 61 convey the sheet P temporarily. The switchback section 62 is formed under the paper receiving tray 59. The switchback section 62 is open at a portion near the reversing rollers 61 in order for the sheet P to be conveyed thereinto.

The pair of paper re-feed rollers 63 is configured to convey the sheet P conveyed by the reversing rollers 61, to the registration rollers 41. The paper re-feed rollers 63 are placed on the reverse route RR, between the reversing rollers 61 and the registration rollers 41. The paper re-feed rollers 63 are driven to rotate by a motor (not shown).

The switch gate 64 is configured to guide the sheet P conveyed by the upper-side conveying rollers 56, to the reversing rollers 61, and also to guide the sheet P conveyed by the reversing rollers 61 out of the switchback section 62, to the paper re-feed rollers 63. The switch gate 64 is placed near the center of three points: the most downstream pair of upper-side conveying rollers 56, the reversing rollers 61, and the paper re-feed rollers 63.

The controller 26 is configured to control the operation of each unit of the printing machine 3, and also to control the external paper feed device 2. The controller 26 is configured including a CPU, a RAM, a ROM, a hard disk, and the like.

The controller 26 is configured to control paper feed as follows. Specifically, after the sheet P strikes the registration rollers 41 and thereby forms a predetermined amount of slack, the controller 26 causes the registration motor 42 to start rotating the registration rollers 41 to convey the sheet P. Then, the controller 26 controls the registration motor 42 such that the registration motor 42 stops the registration rollers 41 once the sheet P exits the registration rollers 41. Here, in stopping the registration rollers 41, the controller 26 controls the registration motor 42 such that the registration motor 42 produces torque in a direction opposite from a direction in which the registration motor 42 rotates in conveying the sheet P.

Next, the operation of the printing system 1 is described.

Once the printing system 1 starts its printing operation, an unprinted sheet P is conveyed to the registration rollers 41 along the paper feed route RS from any one of the paper feed tray 11 of the external paper tray unit 2 and the multiple paper feed trays 31 of the paper feeding unit 21, and is then conveyed to the printing unit 22 by the registration rollers 41. In the printing unit 22, the sheet P is printed with ink ejected from the inkjet head unit 52 while being conveyed by the belt conveyer 51.

In one-sided printing, the sheet P printed on one side thereof is conveyed from the belt conveyer 51 to the upper-side conveying unit 23, is conveyed by the upper-side conveying rollers 56 of the upper-side conveying unit 23, and is thereafter led to the paper discharge route RD by the switcher 57. After that, the sheet P is discharged to the paper receiving tray 59 by the paper discharging rollers 58.

In double-sided printing, after being conveyed by the upper-side conveying rollers 56 of the upper-side conveying unit 23, the sheet P printed on one side thereof is led to the reverse route RR by the switcher 57. In the reversing unit 25, the sheet P is led to the reversing rollers 61 by the switch gate 64, and is conveyed into the switchback section 62 by the reversing rollers 61. Then, the sheet P is conveyed out of the switchback section 62 by the reversing rollers 61 and is led to the paper re-feed rollers 63 by the switch gate 64. The sheet P is then conveyed to the registration rollers 41 by the paper re-feed rollers 63, and is sent to the printing unit 22 by the registration rollers 41. Here, an unprinted side of the sheet P faces the inkjet head unit 52 since the sheet P has been reversed. The printing unit 22 prints the unprinted side of the sheet P with ink ejected from the inkjet head unit 52, while conveying the sheet P with the belt conveyer 51. The sheet P printed on both sides thereof is discharged to the paper receiving tray 59, as is the case for the one-sided printing descried above.

In the printing system 1, in printing multiple sheets, after a certain sheet P is fed, a succeeding sheet P is fed not after the preceding sheet P is printed and discharged, but before the preceding sheet P is discharged. In this way, the printing is performed successively at predetermined intervals. Thus, multiple sheets P are conveyed on the conveyance routes at the same time.

Moreover, in the double-sided printing, except for an adjustment period immediately after starting print and immediately before finishing print, an unprinted sheet P fed from the paper feeding unit 21 and a sheet P printed on its one side and re-fed from the reversing unit 25 are alternately sent to the printing unit 22. Thereby, printing on one side of an unprinted sheet P and printing on the other side (an unprinted side) of a sheet P printed on its one side are performed alternately.

In feeding the sheet P in the printing operation described above, the registration rollers 41 are driven intermittently for sheets to convey. How the registration rollers 41 are driven is described below.

Figure 3:
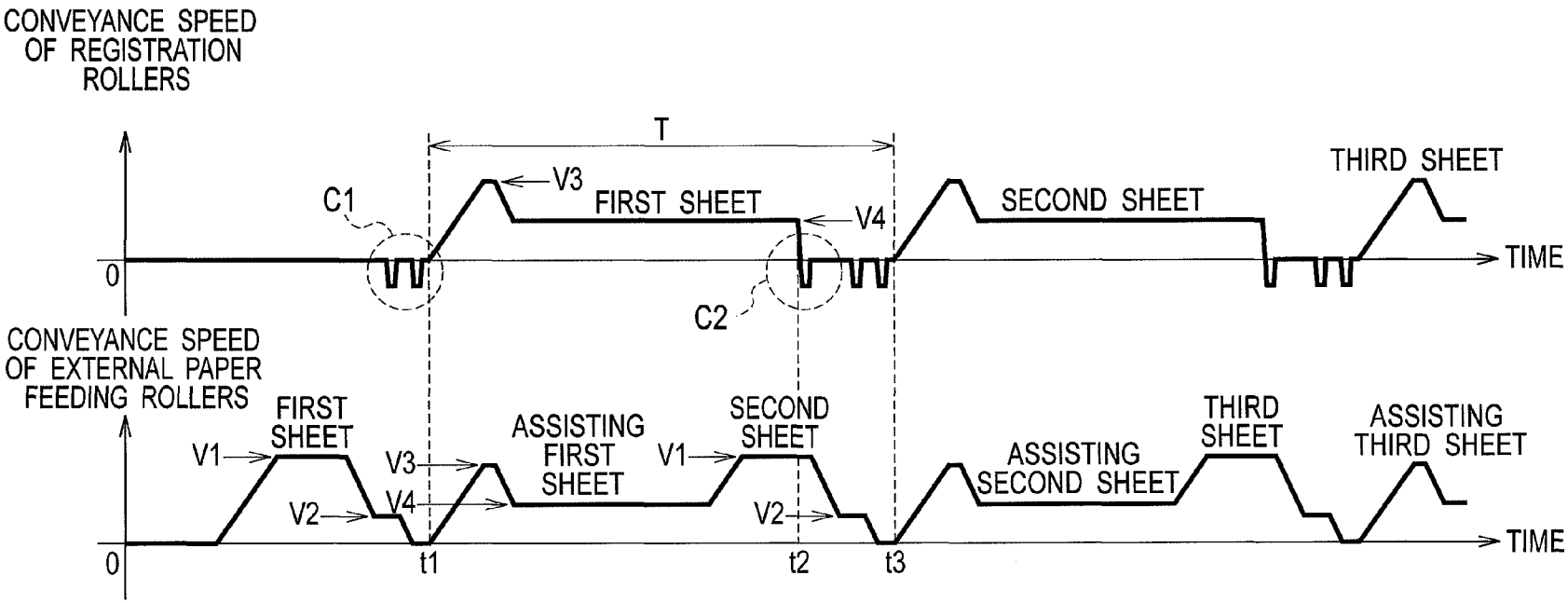
FIG. 3 is a diagram showing a waveform of a controlled conveyance speed of registration rollers and a waveform of a controlled conveyance speed of external sheet feed rollers, in a case of one-side printing on a sheet from an external sheet feed device according to the embodiment of the present invention.

Here, a case is described of one-sided printing on a sheet P from the external paper feed device 2. FIG. 3 is a diagram showing a waveform of a controlled conveyance speed of the registration rollers 41 and a waveform of a controlled conveyance speed of the external sheet feeding rollers 38, in a case of one-sided printing on a sheet P from the external sheet feed unit 2.

First, control of the conveyance speed of the external paper feeding rollers 38 is roughly described. As shown in FIG. 3, to feed a first sheet P, the controller 26 activates the paper feed motor 39 and controls the driving of the paper feed motor 39 such that the conveyance speed of the external paper feeding rollers 38 equals a speed V1 for receiving the sheet P from the intermediate conveying rollers 14. Thereafter, when the registration sensor 44 detects the leading edge of the sheet P, the controller 26 decreases the conveyance speed of the external paper feeding rollers 38 to a speed V2 for striking the sheet P against the registration rollers 41. When the sheet P strikes the registration rollers 41 and forms a predetermined amount of slack, the controller 26 stops the external paper feeding rollers 38 by stopping the paper feed motor 39.

After that, at time t1 at which rotation of the registration rollers 41 is started to convey the first sheet P, the controller 26 activates the paper feed motor 39 so that the external paper feeding rollers 38 start rotating. After the paper feed motor 39 is activated, the controller 26 increases the conveyance speed of the external paper feeding rollers 38 to a speed V3 and then decreases it to a speed V4 so that the external paper feeding rollers 38 may operate in synchronization with the registration rollers 41. The external paper feeding rollers 38 assist the registration rollers 41 in conveying the sheet P, by operating in synchronization with the registration rollers 41. This assisted operation allows the sheet P to be conveyed by the external paper feeding rollers 38 and the registration rollers 41 while maintaining its slack.

At a timing at which the first sheet P exits the external paper feeding rollers 38, the controller 26 increases the conveyance speed of the external paper feeding rollers 38 to the receiving speed V1 so that the external paper feeding rollers 38 can receive a second sheet P. Thereafter, as is the case for the first sheet P, when the registration sensor 44 detects the leading edge of the second sheet P, the controller 26 decreases the conveyance speed of the external paper feeding rollers 38 to the speed V2 for striking the second sheet P against the registration rollers 41. When the second sheet P strikes the registration rollers 41 and forms a predetermined amount of slack, the controller 26 stops the external paper feeding rollers 38 by stopping the paper feed motor 39.

After that, at time t3 at which the registration rollers 41 start to rotate to convey the second sheet P, the controller 26 activates the paper feed motor 39 to start rotating the external paper feeding rollers 38. After that, the controller 26 repeats control similar to what is described above.

Next, control of the conveyance speed of the registration rollers 41 is roughly described. As shown in a circle C1 in FIG. 3, the controller 26 causes the registration rollers 41 to reversely rotate temporarily twice before time t1.

In FIG. 3, a negative conveyance speed indicates a conveyance speed of reverse rotation. Directions of the respective registration rollers 41 rotated to convey the sheet Pin the conveyance direction (rightward), i.e., to the printing unit 22 are normal rotational directions, and directions opposite to those are reverse rotational directions. The controller 26 rotates the registration rollers 41 in the normal rotational directions by causing the registration motor driver 43 to apply positive voltage to the registration motor 42, and rotates the registration rollers 41 in the reverse rotational directions by causing the registration motor driver 43 to apply negative voltage to the registration motor 42.

Out of the two temporary reverse rotations of the registration rollers 41 before time t1, the first one is an entry prevention operation. In the entry prevention operation, the registration rollers 41 are rotated in the reverse rotational directions so as to prevent the leading edge of the sheet P from going beyond a nip line of the registration rollers 41 and entering the registration rollers 41 when striking the registration rollers 41. The second temporary reverse rotation is a sheet return operation. In the sheet return operation, the registration rollers 41 are temporarily rotated in the reverse rotational directions, in case the leading edge of the sheet P is nipped by the registration rollers 41, to release the sheet P from the nipping by returning the sheet P to the nip line.

At time t1, the controller 26 activates the registration motor 42 to rotate the registration rollers 41 in the normal rotation directions. After activating the registration motor 42, the controller 26 increases the conveyance speed of the registration rollers 41 to the speed V3. After that, the controller 26 decreases the speed for conveying the sheet P to the speed V4 for sending the sheet P to the belt conveyer 51.

Figure 5:
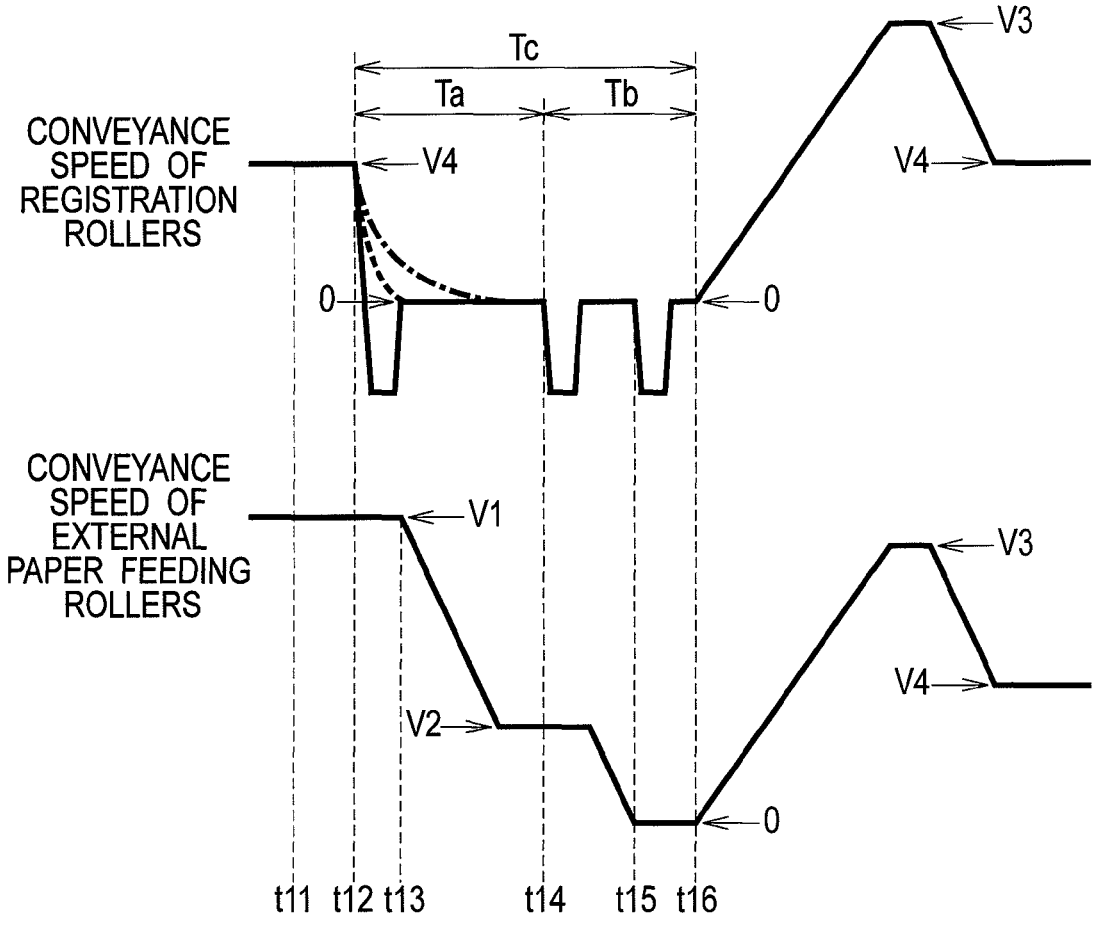
FIG. 5 is a diagram showing a waveform of the controlled conveyance speed of the registration rollers and a waveform of the controlled conveyance speed of the external sheet feed rollers, corresponding to part of FIG. 3.

Then, at time t2 which is a timing for starting control of stopping the registration rollers 41, the controller 26 starts control of stopping the registration rollers 41. In this stop control, the controller 26 controls the driving of the registration motor 42 so that the registration motor 42 temporarily generates reverse-rotational torque to rotate the registration rollers 41 in the reverse rotational direction. Thick solid lines in FIGS. 3 and 5 are set values of the conveyance speeds. When the registration motor 42 is reversely rotated, the set value of the conveyance speed of the registration rollers 41 is a (negative) conveyance speed in the reverse rotation direction, as shown in a circle C2. In contrast, as will be described later, an actual conveyance speed of the registration rollers 41 changes as shown in FIG. 5 with a thick, broken line. In the stop control, the registration motor 42 generates reverse rotational torque so that the registration rollers 41 are stopped with a short period of time.

Thereafter, before time t3, as is the above-described case for before time t1, the controller 26 causes the registration rollers 41 to perform the entry prevention operation and the sheet return operation.

At time t3, to convey a second sheet P, the controller 26 activates the registration motor 42 so that the registration rollers 41 start rotating in the normal rotational directions. After that, the controller 26 repeats control similar to what is described above.

A conveyance schedule for the registration rollers 41 is determined such that one cycle period T is from when the registration rollers 41 are activated to convey a sheet P to when the registration rollers 41 are activated to convey a succeeding sheet P (time t1 to time t3 in FIG. 3).

Figure 4:
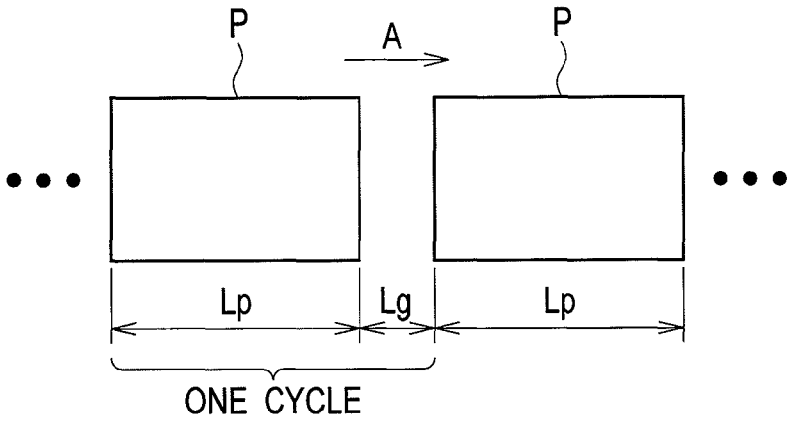
FIG. 4 is a diagram illustrating one cycle.

One cycle period T corresponds to a one-cycle conveyance time of the belt conveyer 51. As shown in FIG. 4, one cycle consists of one sheet P and one inter-sheet portion adjacent thereto. As shown in FIG. 4, one cycle period T is represented by the following formula (1) where Lp is the length of a sheet P in the conveyance direction, Lg is the inter-sheet portion, and A is the conveyance speed of the belt conveyer 51.

$$T=(Lp+Lg)/A \quad (1)$$

Next, a detailed description is given of control of the conveyance speed in stopping and activating the registration rollers 41. FIG. 5 is a diagram showing a waveform of the controlled conveyance speed of the registration rollers 41 and a waveform of the controlled conveyance speed of the external paper feeding rollers 38, the diagram corresponding to part of FIG. 3. FIGS. 6A to 6F are diagrams illustrating how sheets P are conveyed when the registration rollers 41 are stopped and activated.

Figure 6A:
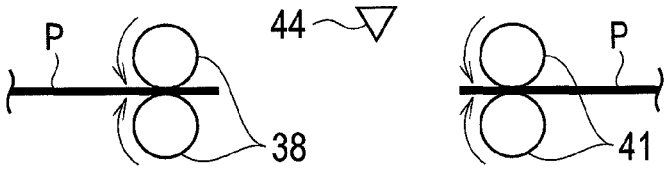
FIGS. 6A to 6F are diagrams illustrating how sheets are conveyed when the registration rollers are stopped and activated.

At time t11 in FIG. 5, as shown in FIG. 6A, the registration rollers 41 are conveying a preceding sheet P, and the external paper feeding rollers 38 are conveying a succeeding sheet P. The registration rollers 41 are conveying the sheet P at the speed V4 for sending the sheet P to the belt conveyer 51. The registration rollers 38 are conveying the sheet P at the speed V1 for receiving the sheet P from the intermediate conveying rollers 14. Time t11 is right before time t12 (corresponding to time t2 in FIG. 3) which is a timing for starting the stop control of the registration rollers 41. Time t12 is a time predetermined by schedule as a time when the tailing edge of the sheet P exits the registration rollers 41.

Figure 6B:
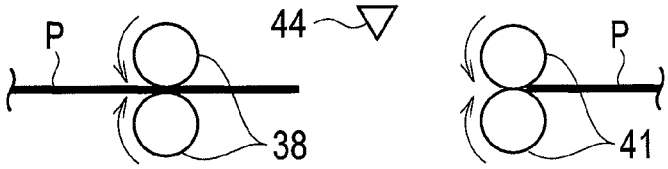

When the tailing edge of the sheet P exits the registration rollers 41 at timing t12 as shown in FIG. 6B, the controller 26 performs the stop control of the registration rollers 41. In this stop control, as described earlier, the controller 26 controls the driving of the registration motor 42 such that the registration motor 42 temporarily generates reverse-rotational torque. Specifically, the controller 26 temporarily applies negative voltage to the registration motor 42, and then returns the voltage to zero.

By this stop control, the actual operation (conveyance speed) of the registration rollers 41 is as shown in FIG. 5 with the thick, broken line, and the registration rollers 41 can be stopped (the conveyance speed thereof can be reduced to zero) with a short period of time from time t12.

Although the conveyance speed of the registration rollers in the normal rotational directions is decreased monotonically to zero in the example shown in FIG. 5 with the thick, broken line, they may be temporarily reversely rotated.

If short-circuit brake control is performed on the registration motor 42 instead of the stop control described above, a period of time required from the stop control start timing to when the registration rollers 41 actually stop is longer than that in the case of the stop control described above, as shown in FIG. 5 with a thick, one-dot chain line. This is because, even if the short-circuit brake control is performed on the registration motor 42, the registration rollers 41 continue to rotate in the normal rotational directions due to influences, such as inertia or load, of a transmission mechanism from the motor shaft of the registration motor 42 to the registration rollers 41, and require a certain amount of time before stopping. In the stop control of this embodiment, the rotation of the registration rollers 41 in the normal rotational directions can be stopped quickly by the registration motor 42 generating reverse-rotational torque. This shortens the time from the stop control start timing to when the registration rollers 41 stop.

Figure 6C:
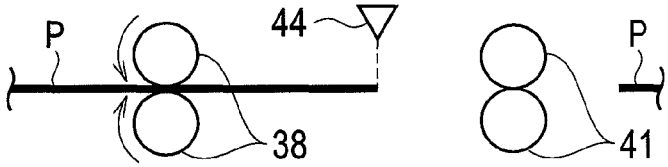

When the leading edge of the succeeding sheet P is detected by the registration sensor 44 as shown in FIG. 6C, the controller 26 starts to speeds down the external paper feeding rollers 38 at time t13. Then, the controller 26 decreases the conveyance direction of the external paper feeding rollers 38 to the speed V2 for striking the sheet P against the registration rollers 41. At time t14 when the external paper feeding rollers 38 are driven at the striking speed V2, the sheet P strikes the registration rollers 41 at the striking speed V2.

Figure 6D:
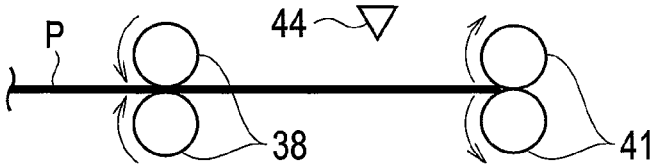

From this time t14, for the entry prevention operation, the controller 26 temporarily applies negative voltage to the registration motor 42 so that the registration rollers 41 temporarily rotate in the reverse rotational directions. Thereby, as shown in FIG. 6D, the registration rollers 41 temporarily rotate in the reverse rotational directions when the sheet P strikes the registration rollers 41.

When the sheet P strikes the stopped registration rollers 41, the registration rollers 41 might rotate in the normal rotational directions by being pushed by the sheet P. Thereby, the leading edge of the sheet P may go beyond the nip line of the registration rollers 41, enter the registration rollers 41, and be nipped by them. In this event, if the sheet P enters the registration rollers 41 with the sheet P inclined and is nipped in that state, the inclination cannot be corrected sufficiently. In this embodiment, as described above, the registration rollers 41 are temporarily rotated in the reverse rotational directions when the sheet P strikes the registration rollers 41, to thereby prevent the leading edge of the sheet P from being nipped by the registration rollers 41.

After the sheet P strikes the registration rollers 41, the controller 26 stops the external paper feeding rollers 38 at time t15. By the rotation of the external paper feeding rollers 38 from time t14 to time t15, the sheet P forms a predetermined amount of slack. The timing for stopping the external paper feeding rollers 38 is predetermined according to schedule.

Figure 6E:
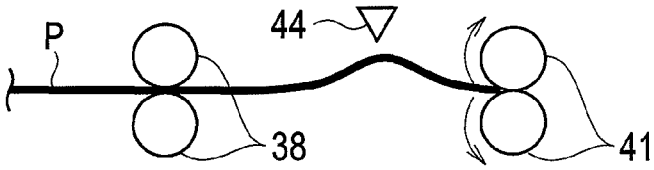

Once the predetermined amount of slack is formed in the sheet P, the controller 26 causes the registration rollers 41 to perform the sheet return operation before timing t16 (corresponding to time t3 in FIG. 3) which is timing for activating the registration rollers 41. Specifically, the controller 26 causes the registration motor driver 43 to temporarily apply negative voltage to the registration motor 42. Thereby, as shown in FIG. 6E, the registration rollers 41 are temporarily rotated in the reverse rotational directions. As a result, in a case where the leading edge portion of the sheet P is nipped by the registration rollers 41, the leading edge of the sheet P can be released from the nipping and returned to the nip line.

Figure 6F:
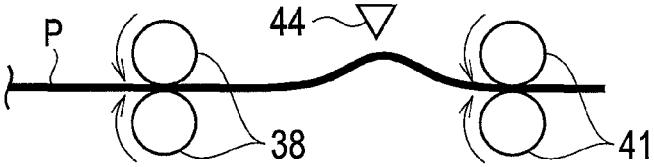

Thereafter, at time t16, the controller 26 activates the registration motor 42 and the paper feed motor 39 to start rotating the registration rollers 41 and the external paper feeding rollers 38 in their normal rotational directions. Thereby, as shown in FIG. 6F, the registration rollers 41 and the external paper feeding rollers 38 convey the sheet P while maintaining the slack thereof.

As described above, when stopping the registration rollers 41, the controller 26 of the printing machine 3 performs control such that the registration motor 42 generates reverse-rotational torque. This can shorten the time from the stop control start timing to when the registration rollers 41 stop. Thus, a time period Ta (see FIG. 5) can be shortened, the time period Ta being from the stop control start timing (time t12) to the timing at which the sheet P strikes the registration rollers 41 (timing t14). Here, a time period Tb from time t14 to time t16 in FIG. 5 is a period of time for forming slack of the sheet P and for preparing for paper feed, and a time period To from time t12 to time t16 is a period of time corresponding to the inter-sheet portion. Thus, decreasing the time period Ta can reduce the interval between the sheets in printing of multiple sheets. As a result, the productivity of the printing machine 3 can be improved.

Further, in the printing machine 3, the registration rollers 41 perform the entry prevention operation. Specifically, from the timing when the sheet P strikes the registration rollers 41, the controller 26 temporarily rotates the registration rollers 41 in the reverse rotational directions. This can prevent the sheet P from being nipped by the registration rollers 41 when striking the registration rollers 41. As a result, failure in the correction of the inclination of the sheet P can be reduced.

Further, in the printing machine 3, the registration rollers 41 perform the sheet return operation. Specifically, when the sheet P strikes the registration rollers 41 to form a predetermined amount of slack in the sheet P, the controller 26 temporarily rotates the registration rollers 41 in the reverse rotational directions before starting to rotate the registration rollers 41 in the normal rotational directions. Thereby, in a case where the leading edge portion of the sheet P is nipped by the registration rollers 41, the leading edge of the sheet P can be released from the nipping and returned to the nip line. As a result, failure in the correction of the inclination of the sheet P can be reduced.

Note that at least any one of the entry prevention operation and the sheet return operation of the registration rollers 41 may be omitted. For example, the entry prevention operation and the sheet return operation may be omitted for a non-elastic sheet which is less likely to enter the registration rollers 41, and performed only for an elastic sheet such as a cardboard.

Although a case of one-sided printing on a sheet P from the external paper feed device 2 is described in this embodiment, similar control of the driving of the registration motor 42 may be performed for one-sided printing on a sheet P from any of the paper feed trays 31 provided inside the printing machine 3. The same applies to double-sided printing.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A conveyance apparatus comprising:

a pair of registration rollers configured to convey a print medium to a printing unit of a printing machine in a conveyance direction;

a motor configured to rotate the registration rollers; and a controller configured to control the motor such that after the print medium strikes the registration rollers and thereby forms a predetermined amount of slack in the print medium, the motor starts rotating the registration rollers to convey the print medium, and the motor stops rotating the registration rollers once the print medium exits the registration rollers, wherein, in stopping rotating the registration rollers, the controller is configured to drive the motor to generate torque in a reverse rotational direction opposite from a rotational direction in which the motor generates torque to convey the print medium in the conveyance direction, and the controller is configured to control the motor such that, at a timing time when the print medium strikes the registration rollers, the motor temporarily rotates the registration rollers in a reverse rotational direction opposite from a rotational direction in which the registration rollers are rotated in conveying the print medium in the conveyance direction, thereby preventing passage of the print medium through the print rollers.

2. The conveyance apparatus according to claim 1, wherein the controller is configured to control the motor such that, after the print medium strikes the registration rollers and thereby forms the predetermined amount of slack in the print medium and before the motor drives the registration rollers to start conveying the print medium, the motor temporarily rotates the registration rollers in a reverse rotational direction opposite from a rotational direction in which the registration rollers are rotated in conveying the print medium in the conveyance direction.

3. The conveyance apparatus according to claim 1, wherein, after the motor rotates the registration rollers in the reverse rotational direction to prevent passage of the print medium through the registration rollers, the controller controls the motor to temporarily rotate the registration rollers in the reverse rotational direction, thereby releasing a leading edge portion of the sheet from being nipped by the registration rollers and returning the leading edge portion of the sheet to a nip line of the registration rollers.

4. The conveyance apparatus according to claim 3, further comprising a pair of paper feeding rollers, wherein the conveyance speed of the paper feeding rollers is different during the stopping of the registration rollers, and during the temporary rotation of the registration rollers in the reverse direction of rotation to prevent passage of the print medium through the print rollers.

5. The conveyance apparatus according to claim 1, wherein the controller controls the motor to stop the registration rollers and generate torque in the reverse direction at a time that the print medium exits the registration rollers.

6. The conveyance apparatus according to claim 1, wherein the controller controls the motor to temporarily rotate the registration rollers in the reverse direction at a time that the print medium strikes the registration rollers.

* * * * *

UNITED STATES PATENT AND TRADEMARK OFFICE

CERTIFICATE OF CORRECTION

PATENT NO. : 9,126,791 B2
APPLICATION NO. : 14/098671
DATED : September 8, 2015
INVENTOR(S) : Inoue It is certified that error appears in the above-identified patent and that said Letters Patent is hereby corrected as shown below:

In the Claims

Column 12, line 54 (claim 1, line 20) please change "a timing time" to -- a time --.

Signed and Sealed this
Fifteenth Day of March, 2016

Michelle K. Lee

Michelle K. Lee
*Director of the United States Patent and Trademark Office*